US008678071B2

(12) United States Patent
Sueta et al.

(10) Patent No.: US 8,678,071 B2
(45) Date of Patent: Mar. 25, 2014

(54) EVAPORATIVE PATTERN, METHOD OF FORMING AN EVAPORATIVE PATTERN, AND METHOD OF FORMING A METAL MOLD BY USING AN EVAPORATIVE PATTERN

(75) Inventors: Hirotake Sueta, Toyota (JP); Kiyoshi Kameyama, Toyota (JP); Atsushi Takemoto, Toyota (JP); Tatsuya Watarai, Toyota (JP); Hitoshi Akimoto, Nagoya (JP); Masaki Yamashita, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/202,458

(22) PCT Filed: Jan. 28, 2011

(86) PCT No.: PCT/JP2011/051823

§ 371 (c)(1),
(2), (4) Date: Aug. 19, 2011

(87) PCT Pub. No.: WO2012/101827

PCT Pub. Date: Aug. 2, 2012

(65) Prior Publication Data

US 2013/0295316 A1 Nov. 7, 2013

(51) Int. Cl.
*B22C 7/02* (2006.01)
*B22C 9/04* (2006.01)

(52) U.S. Cl.
USPC ..... 164/34; 164/45

(58) Field of Classification Search
USPC ..... 164/34, 35, 45
See application file for complete search history.

(56) References Cited

U.S. PATENT DOCUMENTS 2,991,520 A * 7/1961 Dalton ..... 164/131
4,724,889 A * 2/1988 McPherson et al. ..... 164/34

(Continued)

FOREIGN PATENT DOCUMENTS

JP A-61-266147 11/1986
JP A-2-192844 7/1990

(Continued)

OTHER PUBLICATIONS

Sep. 30, 2013 Office Action issued in U.S. Appl. No. 13/202,488.

(Continued)

*Primary Examiner* — Kevin P Kerns
(74) *Attorney, Agent, or Firm* — Oliff PLC

(57) ABSTRACT

A lightweight metal mold having a necessary rigidity is realized. Firstly, an original pattern of an evaporative pattern is formed by machining an evaporative material block. The original pattern includes a three-dimensional mesh structure including a plurality of bar-shaped parts and connecting points that connect ends of the bar-shaped parts and are distributed in a three-dimensional space, and a plurality of block parts having fixed relative positional relationship by being fixed to the three-dimensional mesh structure. Then, at least a portion of at least one or more of the bar-shaped parts composing the original pattern is removed, and replaced with a tube member. Then, a full-mold casting is performed by using the evaporative pattern having the replaced tube member. Positional relationship of the block parts in which surfaces, etc. necessary for the metal mold are formed is fixed by the three-dimensional mesh structure, and the necessary rigidity is secured. The metal mold is made lighter by using the three-dimensional mesh structure. Due to the replacement with the tube member, an amount of gas generated upon the full-mold casting is suppressed, and a decrease in casting quality is prevented.

3 Claims, 10 Drawing Sheets

(56) References Cited

U.S. PATENT DOCUMENTS

| | | | |
|---|---|---|---|
| 5,291,938 | A | 3/1994 | Metevelis et al. |
| 2003/0098136 | A1 | 5/2003 | Ludwig et al. |
| 2007/0044936 | A1 | 3/2007 | Memmen |
| 2013/0025815 | A1 | 1/2013 | Nibouar et al. |
| 2013/0139990 | A1 | 6/2013 | Appleby et al. |
| 2013/0292082 | A1 | 11/2013 | Sato et al. |

FOREIGN PATENT DOCUMENTS

| | | |
|---|---|---|
| JP | A-7-323400 | 12/1995 |
| JP | A-8-1275 | 1/1996 |
| JP | A-2007-260750 | 10/2007 |
| JP | A-2010-112533 | 5/2010 |
| JP | B1-4553271 | 7/2010 |
| JP | A-2011-051824 | 3/2011 |
| JP | A-2011-240351 | 12/2011 |
| WO | WO 00/15370 | 3/2000 |

OTHER PUBLICATIONS

Jan. 21, 2014 Office Action issued in U.S. Appl. No. 13/202,488.

* cited by examiner

EVAPORATIVE PATTERN, METHOD OF FORMING AN EVAPORATIVE PATTERN, AND METHOD OF FORMING A METAL MOLD BY USING AN EVAPORATIVE PATTERN

TECHNICAL FIELD

The present invention relates to an evaporative pattern used in full-mold casting, a method of forming the evaporative pattern, a method of forming a metal mold by using the evaporative pattern, and a cast product that is cast by using the evaporative pattern.

BACKGROUND ART

Full-mold casting is one known method of forming metal products. In full-mold casting, a pattern is prepared that has the same shape as the metal product to be formed. The pattern is formed from a material that evaporates when it comes into contact with molten metal. When the evaporative pattern is packed inside a sand mold and molten metal is poured into the sand mold, the pattern will evaporate and be replaced with the molten metal. When the sand mold is destroyed after the molten metal has cooled, a cast product having the same shape as the pattern will be obtained.

Although full-mold casting is an excellent method for forming metal products having complex shapes, one problem is that it is difficult to fill the powder material that forms the sand mold around the evaporative pattern. In general, metal molds have complex shapes, therefore, the evaporative patterns for the metal molds have complex shapes. Cavities are easily formed around an evaporative pattern having a complex shape (i.e., spaces that are not filled with the powder material are left around the evaporative pattern) when the evaporative pattern is packed in a sand mold. Thus, difficult work will need to be continued over a long period of time in order to form a good sand mold.

A standard metal mold is formed by machining a metal blank, and comprises a mold surface that comes into contact with a work piece and a positioning surface that contacts the other side of the metal mold and adjusts the positional relationship with the other side of the metal mold. The metal blank on the back sides of the mold surface and the positioning surface plays a role in providing the mold surface, providing the positioning surface, and fixing the relative positional relationship between the mold surface and the positioning surface. Here, the portion that fixes the relative positional relationship between the mold surface and the positioning surface need not be a metal blank.

Patent Reference 1 discloses a press die that reinforces the lower die made of a plate with a lower frame, and reinforces the upper die made of a plate with an upper frame. The upper frame and lower frame used here are comprised of a plurality of bar-shaped members, as well as a three-dimensional mesh structure having connecting points that link the ends of the bar-shaped members and are distributed inside a three-dimensional space. By using a three-dimensional mesh structure instead of a metal blank, a product capable of being used as a metal mold can be achieved.

PRIOR ART REFERENCE

Patent Reference

Patent Reference 1: Japan Published Unexamined Patent Application No. 7-323400

With a metal mold having a portion of the metal blank replaced with a three-dimensional mesh structure, the task of filling the powder material around the evaporative pattern for forming the metal mold will be simplified. A metal mold in which a portion thereof is replaced with a three-dimensional mesh structure will be easy to form with full-mold casting. In addition, a metal mold in which a portion thereof is replaced with a three-dimensional mesh structure will also have advantages, such as being lightweight, the rigidity thereof can be easily adjusted, and the heat radiation characteristics thereof can be easily adjusted. The present inventors have discovered the advantages of a metal mold in which a portion thereof is replaced with a three-dimensional mesh structure, have discovered the good compatibility between that metal mold and full-mold casting, and are conducting research on technology for forming that metal mold by means of full-mold casting in which a portion of the evaporative pattern is replaced with a three-dimensional mesh structure.

SUMMARY OF INVENTION

Technical Problem

As a result of this research, the present inventors found that when the bar-shaped parts of the evaporative pattern packed in the sand mold evaporate due to the heat of the molten metal, the gas generated thereby interferes with the penetration of the molten metal into the spaces in the sand mold formed when the bar-shaped parts evaporate. Thus, the present inventors found that the quality of the cast product sometime declines due to the gas. The present invention provides technology that allows molten metal to be reliably poured into bar-shaped parts of an evaporative pattern, and allows the bar-shaped parts of the evaporative pattern to be reliably substituted with cast metal.

Solution to Technical Problem

The present invention can be embodied in a method of forming a metal mold. When the present invention is embodied in a method of forming a metal mold, an original pattern of an evaporative pattern will be formed by machining a block of evaporative material. The original pattern formed in this step comprises a three-dimensional mesh structure that includes a plurality of bar-shaped parts and connecting points that connect ends of the bar-shaped parts, the connecting points being distributed in a three-dimensional space. The original pattern formed in this step also comprises a plurality of block parts having a fixed relative positional relationship by being fixed to the three-dimensional mesh structure. When the present invention is embodied in a method of forming a metal mold, after forming the original pattern of the evaporative pattern, at least a portion of at least one or more of the bar-shaped parts of the original pattern will be removed, the removed portion will be replaced with a tube member, and a full-mold casting will be performed by using the evaporative pattern having the replaced tube member.

In the aforementioned method of forming a metal mold, all of the bar-shaped parts may be replaced with a tube member, or portions thereof in which it is difficult for molten metal to flow may be selected and replaced. For example, a bar-shaped part having a narrow cross-sectional area can be selected and replaced with a tube member, or a bar-shaped part in which it is difficult for the molten metal to flow because the bar-shaped part is located at a position remote from the molten metal fill port can be selected and replaced with a tube member.

In addition, the term "full-mold casting" here is not limited to situations in which an evaporative pattern in a sand mold is evaporated by molten metal, and may include situations in which an evaporative pattern within a sand mold is evaporated prior to pouring molten metal.

Typical examples of a three-dimensional mesh structure include a truss structure, a Rahmen structure, or a structure including both a truss structure and a Rahmen structure. A three-dimensional framework (framework structure) is also possible.

The aforementioned method of forming a metal mold has the following excellent characteristics.

(1) The original pattern of the evaporative pattern will have a highly accurate shape because the original pattern of the evaporative pattern is formed by machining a block of material.

(2) The original pattern of the evaporative pattern will have a highly accurate shape because a full set of bar-shaped parts that comprise the three-dimensional mesh structure is formed.

(3) The amount of gas generated by the portions replaced with the tube members will be suppressed, and a phenomenon in which the flow of molten metal is inhibited by the gas will be suppressed, because full-mold casting is performed by using an evaporative pattern in which at least a portion of at least one or more of the bar-shaped parts was replaced with a tube member.

(4) A metal mold can be formed that is both lightweight and has the necessary rigidity because a three-dimensional mesh structure is used.

The present invention can also be embodied in a method of forming an evaporative pattern used in full-mold casting. When the present invention is embodied in a method of forming the evaporative pattern, a three-dimensional mesh structure is formed by machining an evaporative material block, the three-dimensional mesh structure including a plurality of bar-shaped parts and connecting points that connect ends of the bar-shaped parts, and the connecting points being distributed in a three-dimensional space. In this method, at least a portion of at least one or more of the bar-shaped parts are removed, and the removed portion is replaced with a tube member.

The evaporative pattern formed as noted above is particularly useful when the evaporative pattern has a shape of a metal mold, but is not limited thereto. An evaporative pattern used in full-mold casting for forming a jig, press platen, work piece loading stand, etc. is also possible. An evaporative pattern that does not have block parts is also useful when the necessary function can be achieved with only a three-dimensional mesh structure.

The present invention can also be embodied in a novel evaporative pattern used in full-mold casting. This novel evaporative pattern comprises a three-dimensional mesh structure that includes a plurality of bar-shaped parts formed of an evaporative material, and connecting points that connect the ends of the bar-shaped parts, the connecting points being distributed in a three-dimensional space, and at least a portion of at least one or more of the bar-shaped parts is formed of a tube member. This evaporative pattern may be one in which a portion of some of the bar-shaped parts are replaced with a tube member after the original pattern of the evaporative pattern having all bar-shaped parts is produced, or may be one in which a tube member is added after the original pattern of the evaporative pattern is produced in which the bar-shaped parts to be replaced with a tube member were originally removed. Or, the pattern may be one in which the plurality of bar-shaped members is assembled to form the three-dimensional mesh structure by using the plurality of connecting members that connect the ends of the bar-shaped members. In the latter situation, an evaporative pattern in which at least a portion of at least one or more of the bar-shaped parts of the three-dimensional mesh structure is hollow is formed by assembling at least one or more tube members.

The aforementioned tube member may be formed with an evaporative material, or may be formed with a non-evaporative material. When formed with an evaporative material, full-mold casting in which the tube member evaporates will be performed. Full-mold casting in which the tube member evaporates includes situations in which the tube member evaporates and is replaced with molten metal, and situations in which a solid remains after evaporation and is not replaced with molten metal. In the later situations, the tube member is carbonized by the heat of molten metal and is destroyed together with the sand mold.

When the tube member is formed with a non-evaporative material, a cast product will be formed in which molten metal is poured into and solidifies within a tube member that remains after full-mold casting. In other words, a composite cast product will be obtained that comprises a cast metal product and a tube member. An outer surface of at least a portion of at least one or more of the bar-shaped parts is formed of a tube member, and a cast metal product fills inside the tube member. A cast product that is formed with full-mold casting by using an evaporative pattern comprising a non-evaporative tube member is a combination of a cast metal product in which molten metal has been solidified, and a tube member that is present prior to casting. This is referred to here as a composite cast product.

The evaporative pattern for obtaining a composite cast product with full-mold casting may be one in which a portion of some of the bar-shaped parts is replaced with a tube member after an original pattern of an evaporative pattern including all bar-shaped parts is produced, or may be one in which a tube member is added after an original pattern of an evaporative pattern is produced in which the bar-shaped parts to be replaced by tube members were originally removed. In addition, the pattern may be one that is formed from an original pattern that was machined from an evaporative material block, or may be a pattern which is a combination of a plurality of bar-shaped members and connecting members that connect the ends of the bar-shaped members. In the latter situation, a composite cast product can be obtained by using a non-evaporative tube member. In the composite cast product, outer surface of at least a portion of at least one or more of the bar-shaped parts is made with a tube member, and the cast metal fills the interior of the tube member.

DESCRIPTION OF EMBODIMENTS

Figure 1:
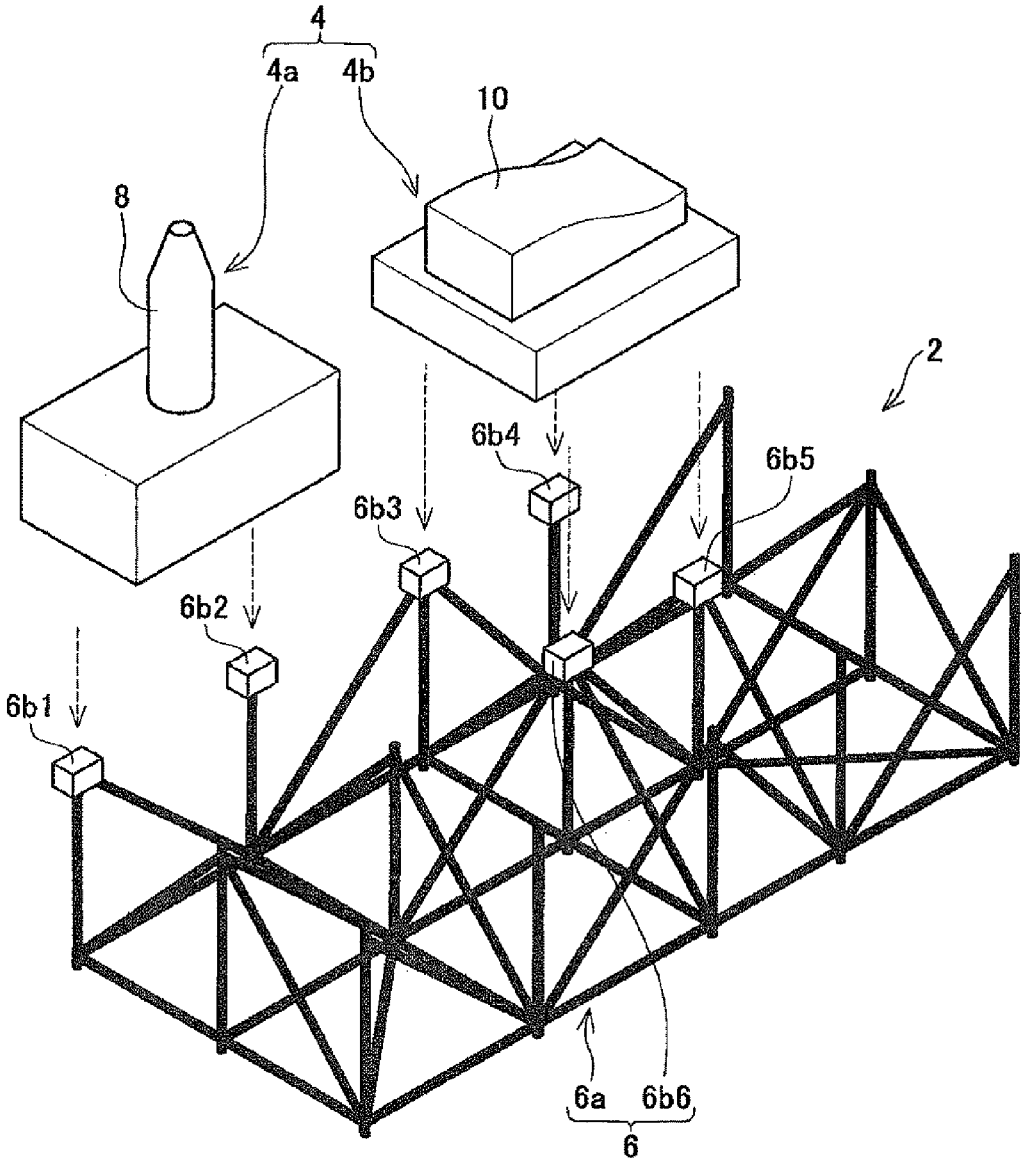
FIG. 1 shows an exploded perspective view showing a portion of an evaporative pattern used in full-mold casting.

FIG. 1 shows an exploded perspective view of a portion of an evaporative pattern 2 in which a portion thereof is formed with a three-dimensional mesh structure 6. FIG. 1 shows blocks 4*a*, 4*b* separated from the three-dimensional structure 6, but in fact the blocks 4*a*, 4*b* are fixed to the three-dimensional mesh structure 6, and the relative positional relationship of the blocks 4*a*, 4*b* is fixed in a defined positional relationship by the three-dimensional mesh structure 6.

The evaporative pattern 2 is formed by machining a block of polystyrene foam. By using a machine tool that both rotates an end mill, and adjusts the relative positional relationship of the work piece and the end mill to a desired positional relationship, the evaporative pattern 2 can be cut out from the block of polystyrene foam.

Figure 2:
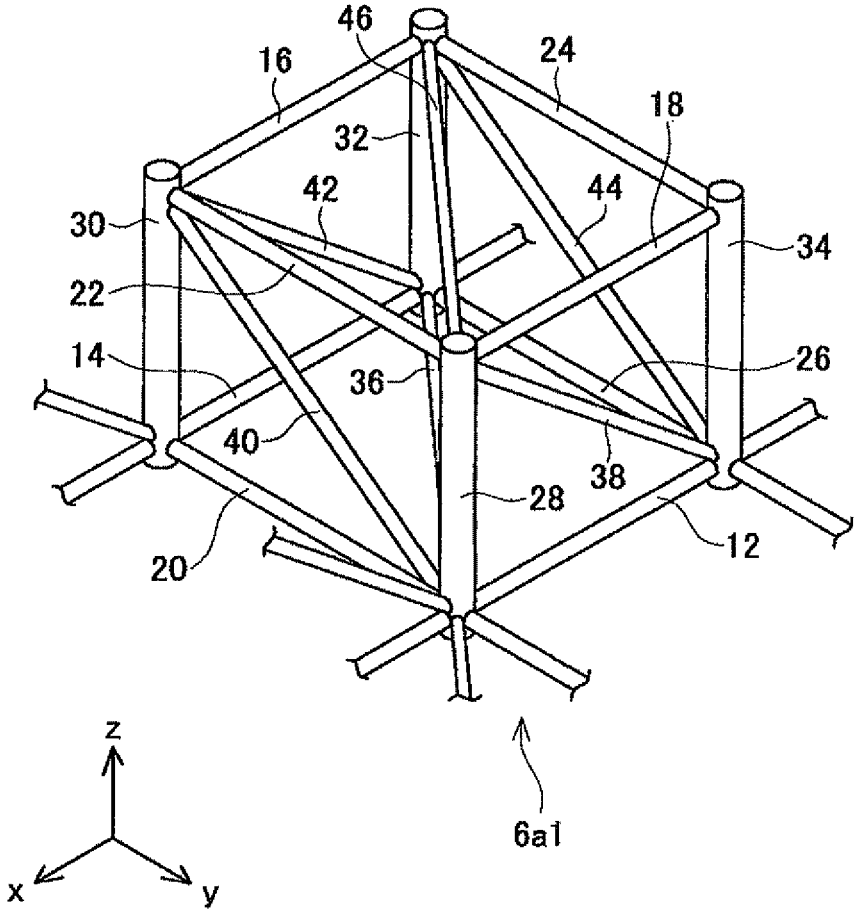
FIG. 2 shows an enlarged perspective view of a portion of the evaporative pattern of FIG. 1.

The three-dimensional mesh structure 6 is formed with a plurality of bar-shaped parts 6*a*, the ends of the bar-shaped parts 6*a* are connected, and these connecting points are distributed inside a three-dimensional space. FIG. 2 is a perspective view showing an enlarged portion of the three-dimensional mesh structure 6, which is basically formed into a unit of 12 bar-shaped parts that are constructed of 4 bar-shaped parts 12, 14, 16, 18 that extend in the x direction, 4 bar-shaped parts 20, 22, 24, 26 that extend in the y direction, and 4 bar-shaped parts 28, 30, 32, 34 that extend in the z direction. The 12 bar-shaped parts form the edge lines of a rectangle. 1 bar-shaped part that forms a diagonal line is arranged on each of the 6 faces that form the rectangle. In FIG. 2, a bar-shaped part 36 is arranged on the bottom face, bar-shaped parts 38, 40, 42, 44 are arranged on the four side faces, and a bar-shaped part 46 is arranged on the upper face. The bar-shaped parts 12-46 form a truss structure.

Figure 3:
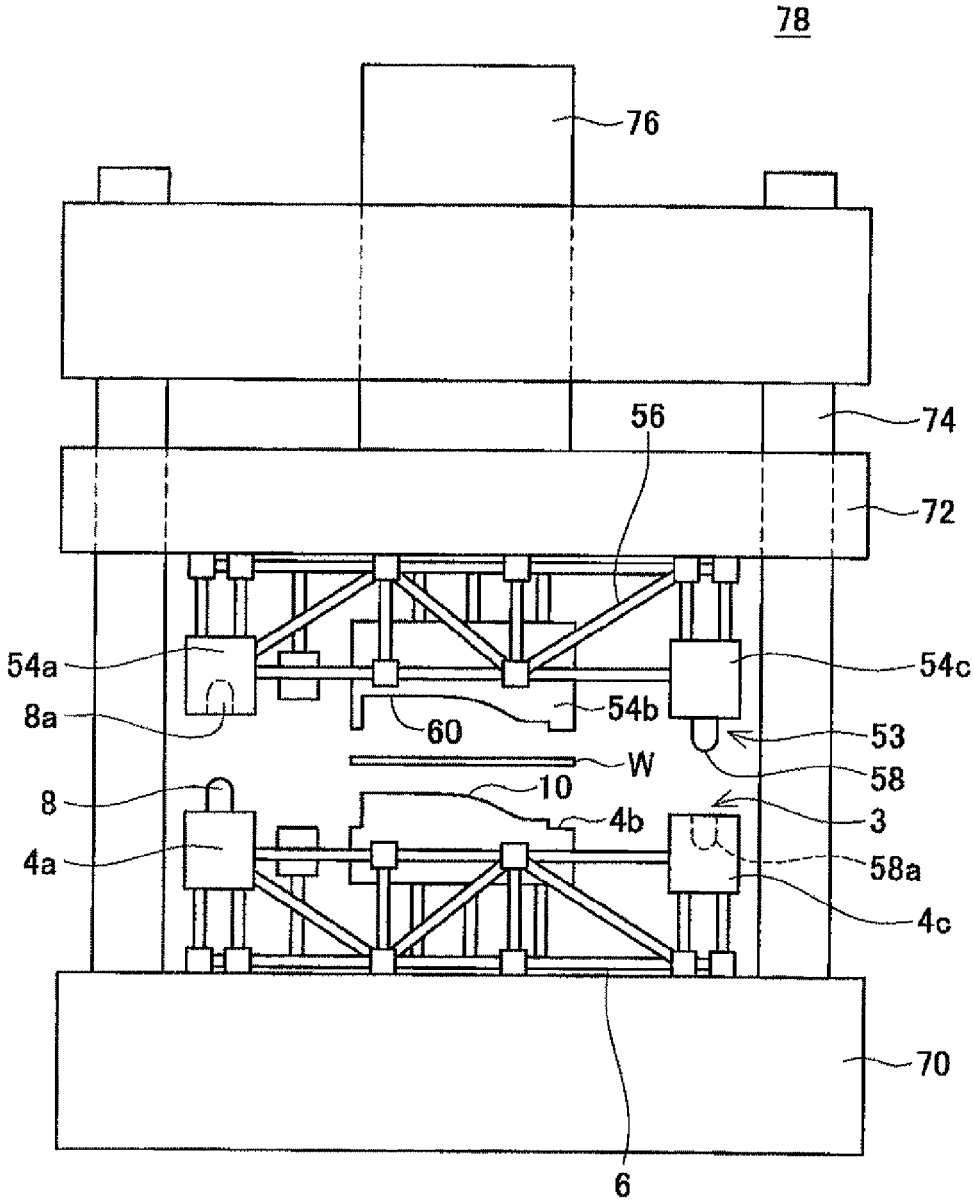
FIG. 3 shows a metal mold comprising a three-dimensional mesh structure that is formed with full-mold casting set into a press.
Figure 4:
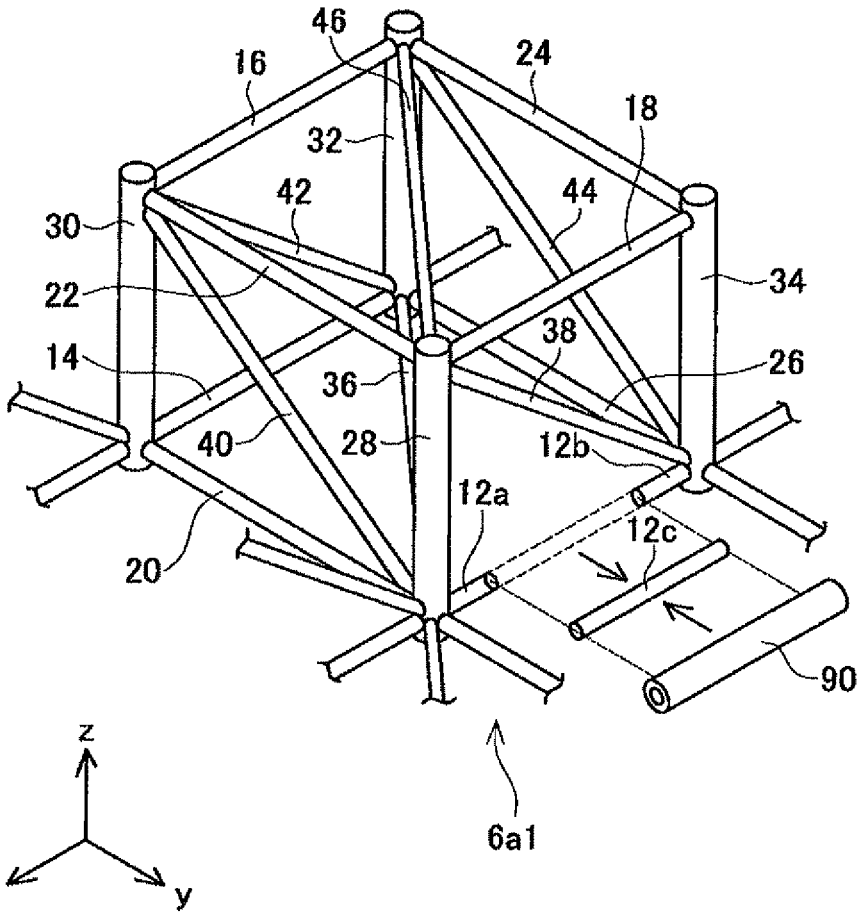
FIG. 4 shows the act of eliminating a portion of a bar-shaped part of the evaporative pattern and replacing it with a tube member.
Figure 5:
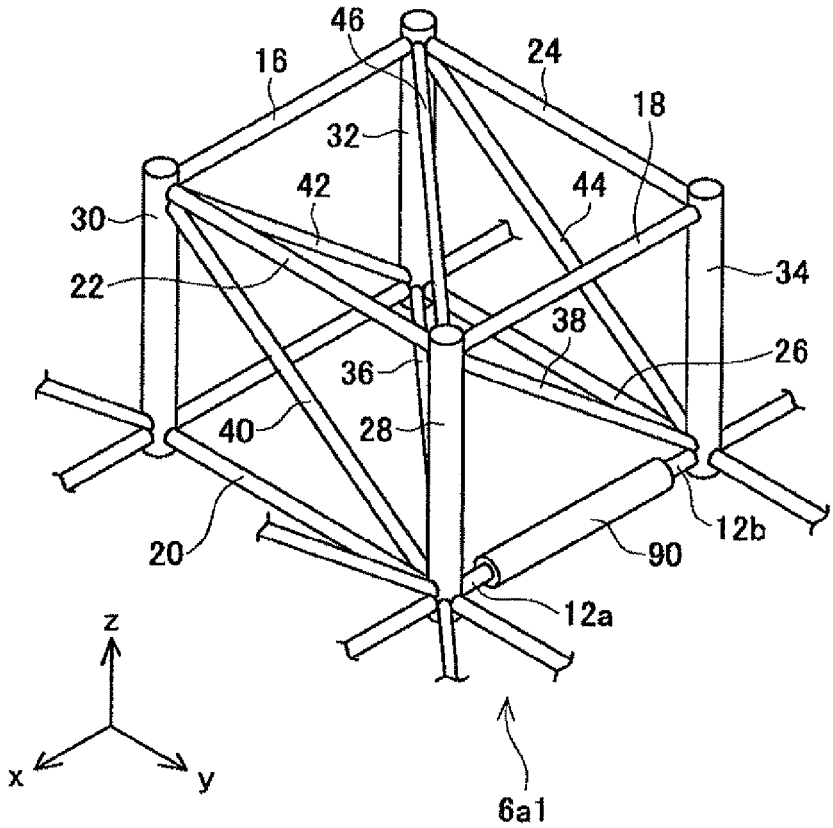
FIG. 5 shows the aftermath of eliminating a portion of a bar-shaped part of the evaporative pattern and replacing it with a tube member.

The actual mesh structure 6 does not have a unit structure 6*a*1 that regularly repeats as shown in FIGS. 2, 4, and 5 but as shown in FIG. 1 or FIG. 3, some bar-shaped parts will be omitted and some bar-shaped parts will be added. The three-dimensional mesh structure 6 may be a Rahman structure, or a mixture of truss and Rahman structures. The length of the bar-shape parts may be identical, or may vary by location. Note that the bar-shaped parts are not necessarily straight, and may also be curved.

As shown in FIG. 1, connecting parts 6*b* are formed at some of the positions in which the ends of the bar-shaped parts connect. In FIG. 1, 6 connecting parts from 6*b*1 to 6*b*6 are formed. In the present specification, numerical subscripts will be omitted when describing common features of parts shown with reference numerals such as 6*b*1, 6*b*2, etc.

The mesh structure 6 of FIG. 1 is formed by machining a block of polystyrene foam, and is not formed by connecting the bar-shaped members. Even though connecting parts are not formed, a structure in which the ends of the bar-shaped parts are connected can be provided. The connecting parts 6*b* of FIG. 1 are selectively formed in positions that connect the block 4*a* with the mesh structure 6, and positions that connect the block 4*b* with the mesh structure 6. In other positions, the ends of the bar-shaped parts are directly connected, and connecting parts are not formed. Note that the mesh structure 6 and the blocks 4*a*, 4*b* may be fixed so that the connecting parts 6*b* are not therebetween. The bar-shaped parts 6*a* that form the mesh structure 6 and the blocks 4*a* 4*b* may be a directly connected. In the present specification, the bar-shaped parts are distinct from the bar-shaped members. The bar-shaped parts are parts that form a part of a large object and have a bar shape. The bar-shaped members are independent members that are bar-shaped. The same applies for connecting parts and connecting members, block parts and block members, and tube parts and tube members, e.g., a tube member is an independent member that is tube-shaped.

The block 4*a* is fixed to the mesh structure 6 via the connecting parts 6*b*1, 6*b*2, etc. A guide pin 8 is fixed to the block 4*a*. The block 4*b* is fixed to the mesh structure 6 via the connecting parts 6*b*3, 6*b*4, 6*b*5, and 6*b*6. A machined surface 10 is formed on the block 4*b*. In fact, a block 4*c* that is not illustrated (see FIG. 3) is also fixed to the mesh structure 6.

The evaporative pattern 2 is formed by machining a block of polystyrene foam, and comprises a mesh structure 6 having a plurality of bar-shaped parts 6*a* and a plurality of connecting parts 6*b*1-6*b*6 etc., and blocks 4*a*, 4*b* that are fixed to the mesh structure 6. When this evaporative pattern 2 is used to perform full-mold casting, a cast product will be obtained that has the same shape as the evaporative pattern. 2. In the present embodiment, this cast product is used as a metal mold 3 for pressing.

FIG. 3 shows a metal mold 3 for pressing that was cast by full-mold casting and fixed to a bolster 70 of a press 78, and a metal mold 53 for pressing that was also cast by the full-mold casting and fixed to a slider 72 of the press 78. Note that 74 in the drawing is a slide guide for the press 78, and 76 is an actuator for the press 78. When the actuator 76 operates, the slider 72 drops downward along the slide guide 74. When this occurs, the guide pin 8 of the metal mold 3 will be inserted into a positioning hole 8*a* of the metal mold 53, a guide pin 58 of the metal mold 53 will be inserted into a positioning hole 58*a* of the metal mold 3, and the relative positional relationship between the metal mold 3 and the metal mold 53 will be positioned in a prescribed positional relationship. The block 4*a*, the guide pin 8, the block 4*b*, the machined surface 10, etc. of FIG. 1 are portions of the evaporative pattern, and formed with polystyrene foam. In contrast, the block 4*a*, the guide pin 8, the block 4*b*, the machined surface 10, etc. of FIG. 3 are portions of the metal mold 3, and formed with cast metal. Although the same reference numerals are used for the sake of convenience, they are in fact different members. Because they are shown as having the same shape, the same reference numerals are used for the sake of convenience.

In the metal mold 3, the blocks 4*a*, 4*c* are fixed with respect to the block 4*b* by means of the mesh structure 6. Likewise in the metal mold 53, the blocks 54*a*, 54*c* are fixed with respect to the block 54*b* by means of a mesh structure 56. If the block 4*a* and the block 54*a* are positioned in a prescribed positional relationship, and the block 4*c* and the block 54*c* are positioned in a prescribed positional relationship, the block 4*b* and the block 54*b* will also be positioned in a prescribed positional relationship. As a result, the machined surface 10 of the metal mold 3 and a machined surface 60 of the metal mold 53 will also be positioned in a prescribed positional relationship. When the slider 72 drops down, the work piece W will be sandwiched between the machined surface 10 of the metal mold 3 and the machined surface 60 of the metal mold 53, and will be pressed into a prescribed shape.

In the aforementioned embodiment, the machined surface 10 is provided by one of the blocks 4*b*, but the machined surface 10 may be divided into a plurality of blocks. Likewise, the machined surface 60 may be divided into a plurality of blocks. Depending on the press, the metal mold 3 may not have the guide pin and the positioning hole. In this case, the guide pin and the positioning hole are formed separately from the metal mold 3. In this case, the blocks 4*a*, 4*c* will not be fixed on the mesh structure 6. Only the plurality of blocks that form the machined surface 10 can be fixed to the mesh structure 6.

The metal mold 3 comprises a structure in which the blocks 4*a*, 4*c* for positioning and the block 4*b* for machining are fixed to the three-dimensional mesh structure 6. The metal mold 3 is lightweight because the portion that fixes the positional relationship of the blocks is the three-dimensional mesh structure 6 and not a metal block. In addition, the blocks can be connected with an appropriate amount of rigidity because the positional relationship of the blocks is prescribed by the three-dimensional mesh structure 6. For example, the rigidity between the blocks can be adjusted to be stiff such that when the block 4*a* and the block 54*a* are positioned in a prescribed positional relationship, and the block 4*c* and the block 54*c* are positioned in a prescribed positional relationship, the block 4*b* and the block 54*b* are also positioned in a prescribed positional relationship. At the same time, the rigidity between the blocks can be adjusted to be flexible such that when the machined surface 10 of the block 4*b* and the machined surface 60 of the block 54*b* are slightly tilted at the prescribed positional relationship and a localized range of the machined surface 10 and the machined surface 60 press strongly on the work piece W, the block 4*b* and the block 54*b* can be rotated relative to each other due to the localized reaction force and the machined surface 10 and the machined surface 60 uniformly press on the work piece W.

The evaporative pattern 2 comprising the blocks 4*a*, 4*b*, 4*c* and the mesh structure 6 can be easily packed in a sand mold, and it will be difficult for spaces to remain around it. It has good compatibility with full-mold casting. The task of packing sand around the evaporative pattern 2 can be performed relatively easily and completed in a short period of time, and a good quality sand mold can be obtained which is filled with powder material around the evaporative pattern 2 without gaps and with a uniform density. Details on and advantages of full-mold casting performed by using an evaporative pattern constructed of a plurality of blocks and a three-dimensional mesh structure are disclosed in the specification and drawings of Japan Patent Application No. 2010-112533. Note that redundant disclosure therefrom has been omitted.

When full-mold casting is performed by using the evaporative pattern 2 in which a portion thereof is formed with the mesh structure 6, a problem may occur in which the cast product quality declines because molten metal does not easily flow into the bar-shaped part whose cross-section is narrow, or because molten metal does not easily flow into the bar-shaped part that is located at a position remote from the molten metal fill port. In the present embodiment, the problem of cast product quality declining due to molten metal not flowing easily will be eliminated.

FIG. 4 shows a countermeasure in situations in which the cast product quality at the bar-shaped part 12 declines when full-mold casting is performed by using the evaporative pattern 2. The result of research show that the flow of molten metal is impeded by the gas generated when the bar-shaped part 12 formed from polystyrene foam is evaporated, and this causes the cast product quality to decline. Polystyrene is filled to the core of the bar-shaped part 12 because the bar-shaped part 12 is machined from a block of polystyrene foam, a large amount of gas is generated when the bar-shaped part 12 evaporates. It was discovered that if the generation of gas can be suppressed, a decline in the quality of the cast product can be prevented.

Figure 6:
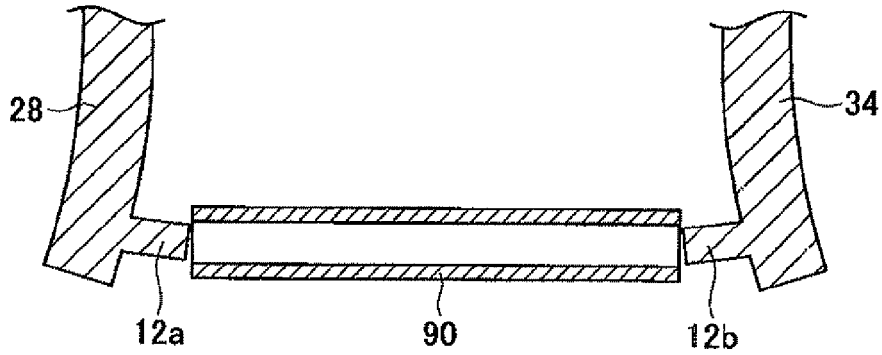
FIG. 6 shows the act of inserting a tube member into the evaporative pattern.

Accordingly, with a bar-shaped part 12 having a lower quality of cast product, a central part 12*c* of the bar-shaped part 12 formed with polystyrene foam will be removed from the evaporative pattern 2. The tube member 90 will be fit in to replace the removed central part 12*c*. In FIG. 4, the central part 12*c* is removed so as to leave portions 12*a* and 12*b* on both ends of the bar-shaped part 12, and the remaining parts 12*a* and 12*b* will be used to fix the tube member 90. FIG. 6 shows a cross-section during the act of using the remaining parts 12*a* and 12*b* to fix the tube member 90. The three-dimensional mesh structure 6 has high rigidity, and if replaced with cast metal will exhibit high rigidity so that it can be used in a metal mold. However, the evaporative pattern is formed with polystyrene foam, and can be flexed within a prescribed range. By using this flexibility and the elastic force that will return polystyrene foam to its original shape, the remaining parts 12*a* and 12*b* can be used to fix the tube member 90. FIG. 6 shows the three-dimensional structure 6 at a condition that the bar-shaped parts 28, 34 connected to both ends of the bar-shaped part 12 to be replaced with the tube member 90 is flexed. FIG. 5 shows the remaining parts 12*a* and 12*b* being used to fix the tube member 90. The remaining part 12*a* and the remaining portion 12*b* are adhered to the tube member 90, in the positional relationship of FIG. 5.

Figure 14:
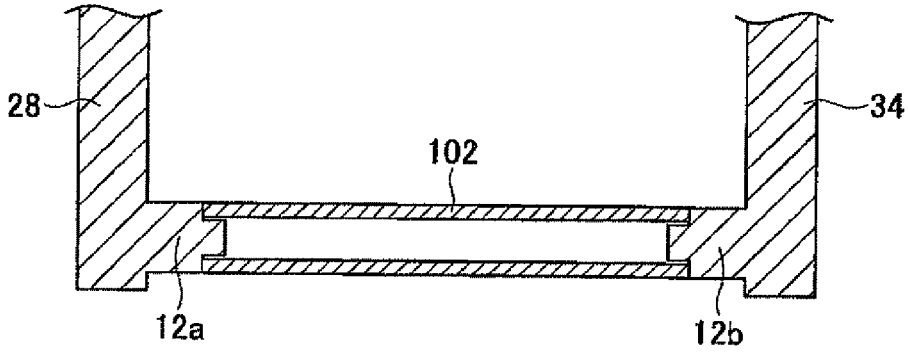
FIG. 14 shows a modification of FIGS. 4 to 6.

FIG. 14 shows a modification of FIG. 5 and FIG. 6. A stepped portion is provided on the remaining parts 12*a* and 12*b*, and this stepped portion may be used to regulate the insertion depth of the tube member 102.

Figure 7:
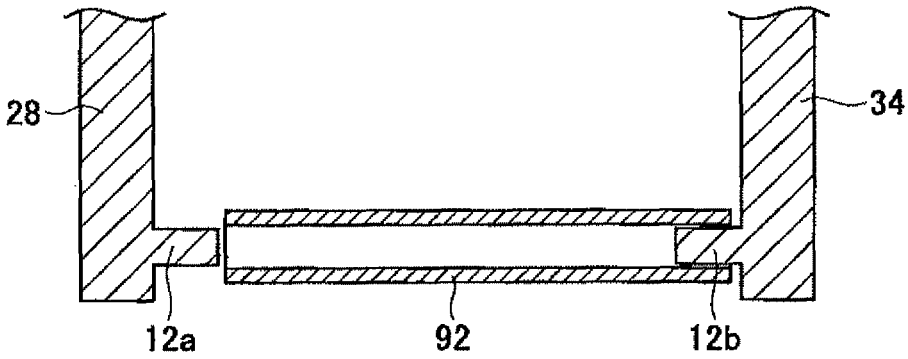
FIG. 7 shows the act of inserting a tube member of a second embodiment into the evaporative pattern.
Figure 8:
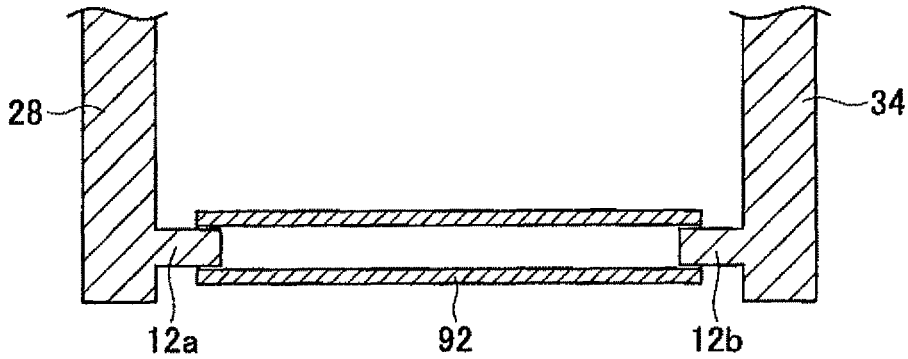
FIG. 8 shows the aftermath of inserting a tube member of the second embodiment into the evaporative pattern.

FIG. 7 shows a second embodiment in which a bar-shaped part is replaced with a tube member 92. In this embodiment, the tube member 92 is deeply inserted into the remaining part 12*b*, and is then slid onto the remaining part 12*a* and adjusted so as to be between the remaining parts 12*a* and 12*b*. The remaining part 12*a* and the remaining portion 12*b* are adhered to the tube member 92, in the positional relationship of FIG. 8.

Figure 9:
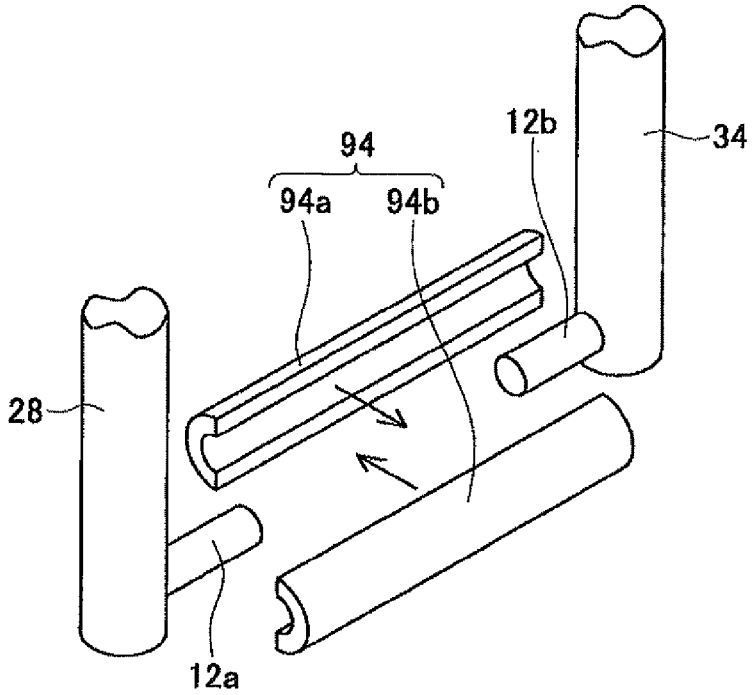
FIG. 9 shows the act of inserting a tube member of a third embodiment into the evaporative pattern.

FIG. 9 shows a third embodiment in which a bar-shaped part is replaced with a tube member 94. In this embodiment, 2 half tube members 94*a* and 94*b* are adhered together to form the tube member 94, and the remaining parts 12*a* and 12*b* are used to fix the tube member 94.

Figure 10:
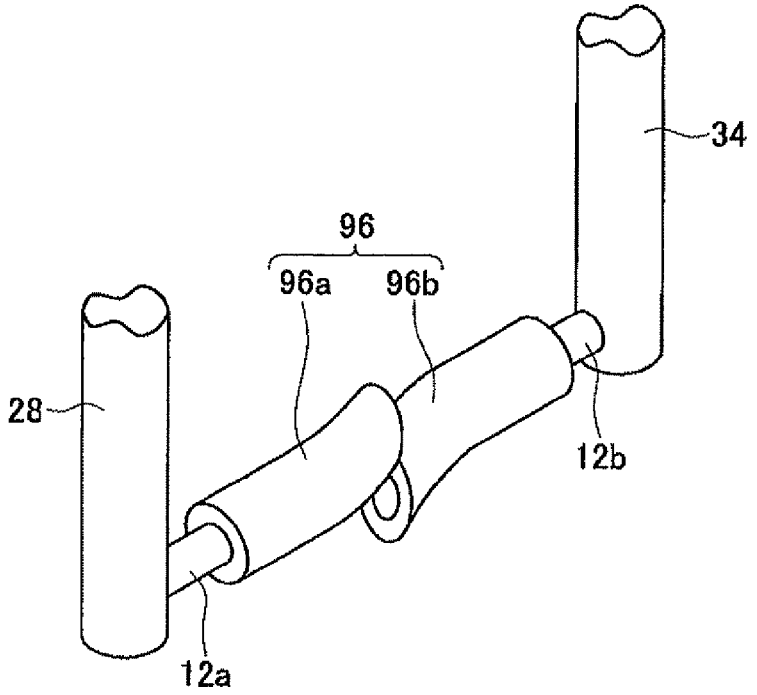
FIG. 10 shows the act of inserting a tube member of a fourth embodiment into the evaporative pattern.

FIG. 10 illustrates a situation in which a boundary surface between a tube member 96*a* attached to the remaining part 12*a*, and a tube member 96*b* attached to the remaining part 12*b*, is cut diagonally. In this situation, the remaining part 12*a* and the remaining part 12*b* can be used to fix the tube member 96 by simply flexing the bar-shaped parts 28 and 34.

Figure 11:
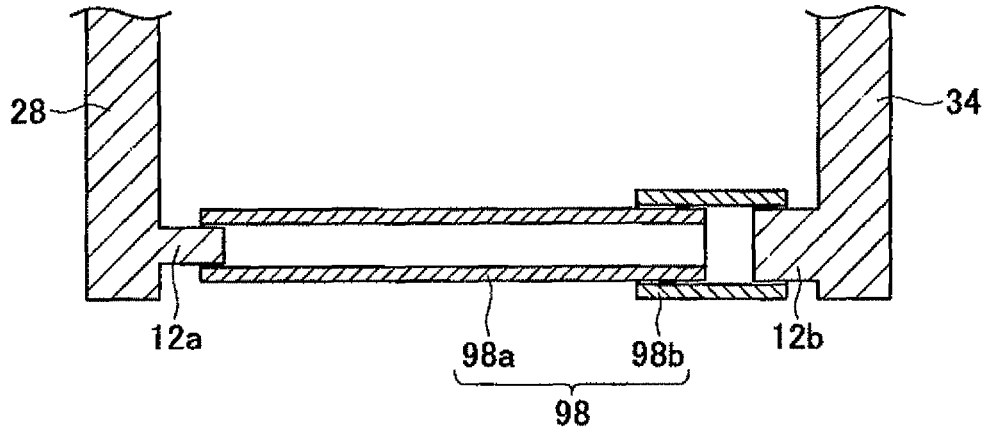
FIG. 11 shows the act of inserting a tube member of a fifth embodiment into the evaporative pattern.

FIG. 11 shows a tube member 98 comprising a large diameter tube member 98*b* that is capable of sliding on a small diameter tube member 98*a*, and in which the tube member 98 is fixed between the remaining parts 12*a* and 12*b*.

Figure 12:
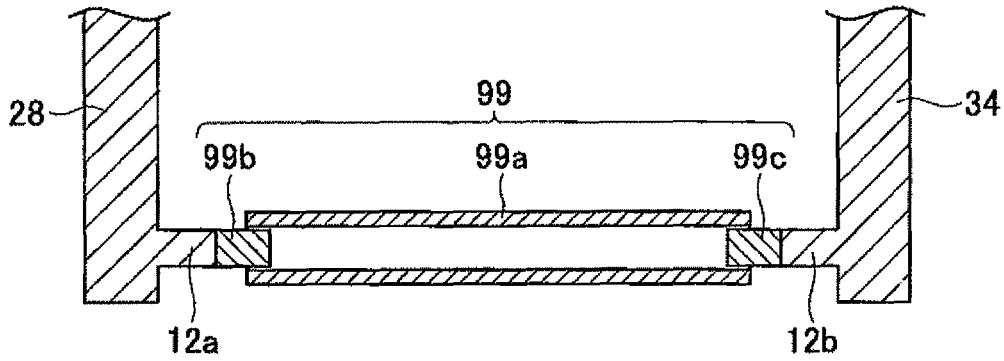
FIG. 12 shows the act of inserting a tube member of a sixth embodiment into the evaporative pattern.

FIG. 12 shows an example in which caps 99*b*, 99*c* made of polystyrene foam are inserted into both ends of a tube member 99*a*, the end surface of the cap 99*b* is adhered to the end surface of the remaining part 12*a*, and the end surface of the cap 99*c* is adhered to the end surface of the remaining part 12*b*. By adjusting the insertion depth of the caps 99*b*, 99*c* made from polystyrene foam, the length of tube member 99 is adjusted to be equal to the gap between the end surface of the remaining portion 12*a* and the end surface of the remaining portion 12*b*.

Figure 13:
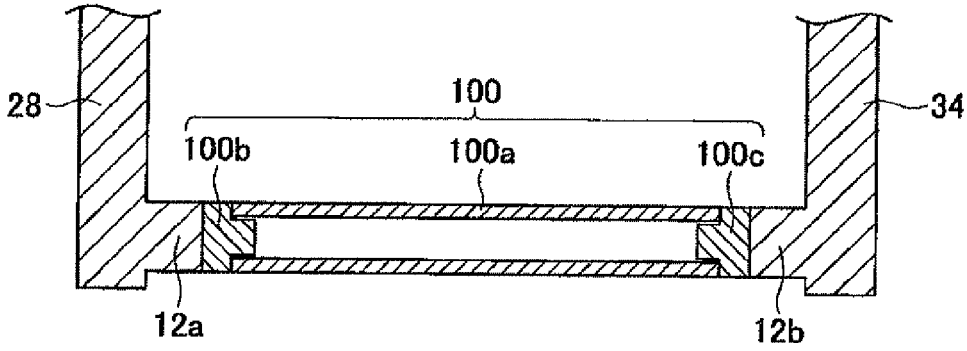
FIG. 13 shows a modification of FIG. 12.

FIG. 13 shows a modification. A stepped portion may be provided on caps 100*b*, 100*c* made of polystyrene foam (inserted into both ends of a tube member 100*a*), and the insertion depth of the caps 100*b*, 100*c* made of polystyrene foam may be regulated to be at a fixed value.

In the present embodiments, the caps 99*b*, 99*c*, 100*b*, 100*c* are formed from polystyrene foam, but may be a material that evaporates during casting, and is not limited to polystyrene foam.

Figure 15:
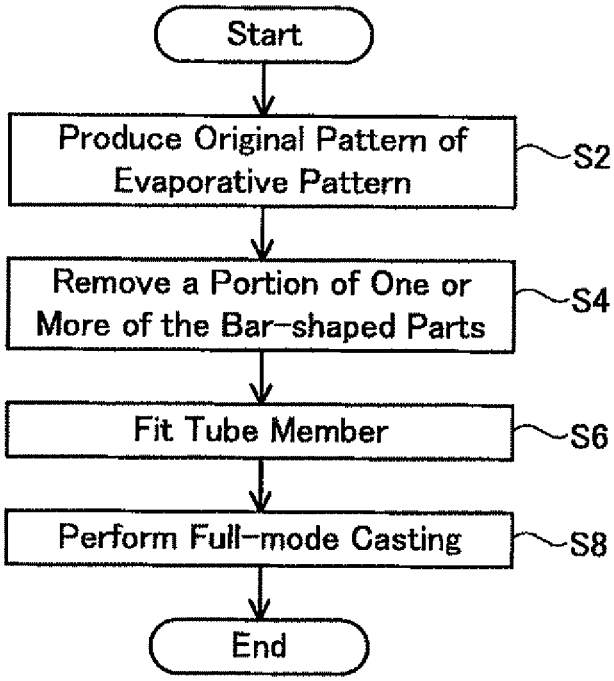
FIG. 15 shows a method of forming a metal mold.

FIG. 15 shows a method of forming the metal mold 3. In Step S2, the original pattern 2 of the evaporative pattern shown in FIG. 1 and FIG. 2 will be produced. In Step S4, as shown in FIG. 4, at least a portion of at least one or more of the bar-shaped parts that form the original pattern 2 will be removed. Note that the original pattern 2 having the shape in Step 4 after a portion of one or more of the bar-shaped parts were removed may be produced in Step S2. In this situation Step S4 can be omitted. In Step S2, when the original pattern 2 of the evaporative pattern having all bar-shaped parts is produced, and a step is performed that removes a portion of one or more of the bar-shaped parts, an original pattern 2 of an evaporative pattern having a high degree of shape accuracy can be obtained for processing. If the original pattern 2 having the shape after removal is produced in Step S2, the task of removal can be rendered unnecessary. In Step S6, the removed bar-shaped part is replaced with a tube member and fitted. In Step S8, an evaporative pattern in which the bar-shaped part is replaced with a tube member is used to perform full-mold casting.

The evaporative pattern to be completed in Step S6 may be directly formed. A composite cast product can be obtained. In the event that bar-shaped members are combined with connecting members to form an evaporative pattern, and if a metal tube is used for the bar-shaped member at a location where the metal tube should remain after full-mold casting, and a polystyrene foam or paper tube member is used for a bar-shaped member at a location where the tube member should not remain after full-mold casting, then a composite cast product in which cast metal fills the interior of the metal tube can be formed.

In the present embodiments, the tube members 90, 92, 94, 96, 98, 99, 100, 102 shown in FIGS. 4 to 14 and thereafter are formed from paper pipes. When an evaporative pattern having a paper pipe is used to perform full-mold casting, the paper pipe will be carbonized by the heat of the molten metal, and when the cast metal product is taken out of the sand mold, the carbonized paper pipe will be removed. Instead of paper, the tube members 90, 92, 94, 96, 98, 99, 100, 102 may be formed of polystyrene foam. In any event, the portion in the vicinity of the core of the tube member is a void, and thus will not evaporate and will not generate gas. The amount of gas generated when performing full-mold casting will be suppressed, and the quality of the cast product can be prevented from declining due to the gas.

Instead of a tube member that evaporates, a tube member that does not evaporate may also be used. For example, a tube member produced from steel used in metal mold may be used. In this situation, the tube member will remain even after full-mold casting has been performed, and a composite cast product filled with solidified cast metal in the interior thereof will be obtained. A composite cast product can also be obtained in which the quality of the material changes depending on the site or location. In this situation, evaporated gas will not be generated at a site having a tube member that does not evaporate, and cast metal will smoothly flow through the interior of the tube member. When replaced with a tube member that does not evaporate at a site at which the quality of the cast product has declined, the decline in the quality of the cast product can be effectively prevented.

Specific embodiments of the present invention are described above, but are mere illustrations and do not restrict the claims. The art set forth in the claims includes variations and modifications of the specific examples set forth above. In addition, the technological components described in the present specification or the drawings exhibit technological utility individually or in various combinations, and are not limited to the combinations disclosed in the claims at the time of application. Furthermore, the art disclosed herein may be utilized to simultaneously achieve a plurality of aims or to achieve one of these aims.

REFERENCE SIGNS LIST

2: Evaporative pattern
4: Block
6: Three-dimensional mesh structure
6*a*: Bar-shaped part
6*b*: Connecting part
8: Guide pin
10: Machined surface
90, 92, 94, 96, 98, 99, 100, 102: Tube member

The invention claimed is:

1. A method of forming a metal mold, comprising:
forming an original pattern by machining an evaporative material block, wherein
the original pattern includes a three-dimensional mesh structure and a plurality of block parts,
the three-dimensional mesh structure includes a plurality of bar-shaped parts and connecting points that connect ends of the bar-shaped parts,
the connecting parts are distributed in a three-dimensional space, and
the plurality of block parts have a fixed relative positional relationship by being fixed to the three-dimensional mesh structure;
removing at least a portion of at least one or more of the bar-shaped parts of the original pattern and replacing the removed portion with a tube member; and
performing a full-mold casting by using the evaporative pattern having the replaced tube member.

2. The method of claim 1, wherein the tube member is formed of an evaporative material.

3. The method of claim 1, wherein the tube member is formed of a non-evaporative material.

* * * * *